US005855653A

United States Patent [19]

Yamamoto

[11] Patent Number: 5,855,653

[45] **Date of Patent: *Jan. 5, 1999**

[54] INDUCED VOLTAGE ELECTRODE FILTER SYSTEM WITH DISPOSABLE CARTRIDGE

[76] Inventor: Yujiro Yamamoto, 1201 Via LaJolla, San Clemente, Calif. 92672

[ * ] Notice: The term of this patent shall not extend beyond the expiration date of Pat. No. 5,647,890.

[21] Appl. No.: 892,346

[22] Filed: Jul. 14, 1997

[51] Int. Cl.[6] ..... B03C 3/155

[52] U.S. Cl. ..... 96/58; 96/59; 96/66; 96/67

[58] Field of Search ..... 96/17, 63, 15, 96/99, 57–59, 65–70; 55/528; 95/57, 63

[56] References Cited

U.S. PATENT DOCUMENTS

| | | | |
|---|---|---|---|
| 4,098,591 | 7/1978 | Van Diepenbroek et al. | 95/57 |
| 5,330,559 | 7/1994 | Cheney et al. | 95/63 |
| 5,368,635 | 11/1994 | Yamamoto | 96/57 |
| 5,403,383 | 4/1995 | Jaisinghani | 96/67 X |
| 5,540,761 | 7/1996 | Yamamoto | 96/99 X |
| 5,647,890 | 7/1997 | Yamamoto | 96/68 X |

*Primary Examiner*—Richard L. Chiesa
*Attorney, Agent, or Firm*—Walter A. Hackler

[57] ABSTRACT

Filter apparatus for trapping particles suspended in gaseous fluid stream generally includes a first and a second electrode with a porous filter therebetween along with electrical contacts for applying a DC voltage across the first and second electrodes. A third electrode is provided and a frame is included for removeably supporting a porous filter, along with the first, second, and third electrodes in order to electrify, by induction, the third electrode with a voltage in the third electrode in order to increase trapping of the particles by the filter apparatus.

23 Claims, 3 Drawing Sheets

INDUCED VOLTAGE ELECTRODE FILTER SYSTEM WITH DISPOSABLE CARTRIDGE

FIELD OF THE INVENTION

This invention relates to filters for removing small particulate materials from a gaseous fluid such as air, and more specifically to a filter, having low pressure drop, long life, low energy cost and high reliability, which meets the needs of modern air purification. The filters in accordance with the present invention utilize an induced voltage electrode to achieve these advantages and further utilize a disposed cartridge to provide a filter system capable of a wide variety of applications.

BACKGROUND OF THE INVENTION

Heretofore, the major purpose of air filtration was to reduce the density of dust, consisting mostly of 0.2 micron, or larger, particles from air. Recent environmental concerns in the living, industrial and military environs have expanded the desired scope of air filtration into the "suppression of odor and virus/germs." Yet current air purification methods are hindered in many ways by an inability to capture undesirable submicron particles, microorganisms, odors, and substances efficiently and economically without suffering from high pressure drop, short life, energy inefficiency, and poor reliability. Simply stated, there is no current adequate method to meet the needs of modern air purification.

There have been thousands of experiments, research efforts, and patents made in the field of air filtration. However, all of this work has followed three existing basic principles: (1) the mechanical filter (mechanical blocking of airborne particles by mesh) (a few hundred years old—but still the most common and widely used method); (2) the electrostatic precipitator (invented 90 years ago in 1906 by Cottrelle, which relies on ionization and the Coulomb's law attraction of particle separation for filtration); and (3) the precharged synthetic fiber filter (precharged fibers create an electrostatic field within the filter material and interact with and capture airborne particles).

The present invention is directed to apparatus and method whereby a properly set non-ionizing electrical field creates a random, high speed, and churning motion of airborne particles in perpendicular directions to the air flow through a filter medium placed in the electric field, see U.S. Pat. No. 5,368,635.

This churning motion inside of a filter medium dramatically increases the probability of particles to bombard the surfaces of the fibers which compose the filter medium. Thus, a combination of such motion and Van der Waals force interaction between particles and fiber surfaces tremendously increases the probability of capturing particles throughout the filter material. This method efficiently captures a wide range of particles, in fact, even submicron particles which are much, much smaller than the porosity of the filter medium used.

The present invention is basically directed to apparatus for positioning of electrodes and a porous material in order to electrify by inducts one of the electrodes with a voltage which results in increase trapping of particular suspended in a gaseous fluid stream. This in turn dramatically upgrades the efficiency of filtration of most of the filter media known today, including paper, glass fiber, synthetic fiber, cloth, natural fiber, foam and electrostatically charged materials. This apparatus and method provides the advantages of 1) high efficiency of filtration, 2) capturing particles in a wide range of sizes, including below submicron sizes, 3) the least amount of pressure drop, 4) improvement in energy efficiency, and 5) low cost. These advantages are achieved without any change in the mechanical properties of the filter.

SUMMARY OF THE INVENTION

Filter apparatus for providing efficient trapping of particles suspended in a gaseous fluid stream generally includes a porous filter, first and second electrodes disposed with the porous filter material therebetween; and a third electrode for producing a synergistic improvement in filtration efficiency.

Means are provided for positioning and supporting said third electrode proximate said first and second electrodes in order to electrify, by induction, the third electrode with a voltage in said third electrode and increase trapping of the particles by the filter apparatus. This occurs when an electrical potential is applied between the first and second electrodes. The third electrode is not directly connected to another electrical power supply nor wired to the other two electrodes, but its electrical potential is induced through air path and/or leak path from nearby electrode.

More particularly filter apparatus in accordance with the present invention may include filter chamber means for defining air flow path between the inlet and outlet and a replaceable porous filter cartridge positioned in the flow path may be provided with the filter cartridge including a filter material having a pore size substantially larger than the average diameter of the particles to be trapped. Further, the material has a collection surface thereon which is substantially greater than the cross section area of the flow path.

Means may be provided for causing the gaseous fluid stream and particles suspended therein to flow along the flow path and through the porous filter cartridge.

First and second electrodes are provided and disposed with the filter material therebetween and having means defining openings therein for enabling air flow therethrough. Means are also provided for applying a select DC voltage across the first and second electrodes and a third electrode is provided which includes means defining openings therein for enabling air flow therethrough.

In addition frame means may be provided for removeably supporting the filter cartridge and supporting the first, second and third electrodes in order to electrify, by induction, the third electrode with a voltage in the third electrode in order to increase trapping of the particles by the filter apparatus.

Still more particularly, the frame means may include separable sub-frame means for enabling replacement of the filter cartridge by separation of the sub-frame means. In addition, at least one of the first and second electrodes may be disposed in the filter cartridge.

Alternatively, both the first and second electrodes may be disposed in the filter cartridge and the means for applying the DC voltage includes electrical contact means disposed on the filter cartridge for enabling maintenance of the electrical potential across the first and second electrodes when the filter cartridge is removed from the frame means in order to prevent release of the trapped particles in the filter cartridge material.

In addition, the filter cartridge may have a varying porosity with increasing pore size along the air flow path. In addition, a second porous filter may be removeably disposed adjacent to the third electrode.

In accordance with the presence invention, a plurality of porous filter cartridges may be provided with each cartridge including different filter material. In this manner a variety of filtering applications may be addressed by the present apparatus. Such applications including filtration of sub-micron odor causing particles, viruses and the like.

Further, the present invention separately encompasses a filter cartridge suitable for filter apparatus including a filter chamber, an induction electrode and means for removably supporting the filter cartridge in the filter apparatus.

More particularly, the filter cartridge includes a porous filter, first and second electrodes disposed with the porous filter therebetween and means for applying a DC voltage across the first and second electrodes. The cartridge by its physical configuration provides a means for enabling positioning and supporting of the first and second electrodes approximate the induction electrode in order to electrify, by induction, the induction electrode with a voltage in the induction electrode in order to increase trapping of particles by the filter cartridge.

BRIEF DESCRIPTION OF THE DRAWINGS

The advantages and features of the present invention will be better understood by the following description when considered in conjunction with the accompanying drawings in which.

DETAILED DESCRIPTION

Figure 1:
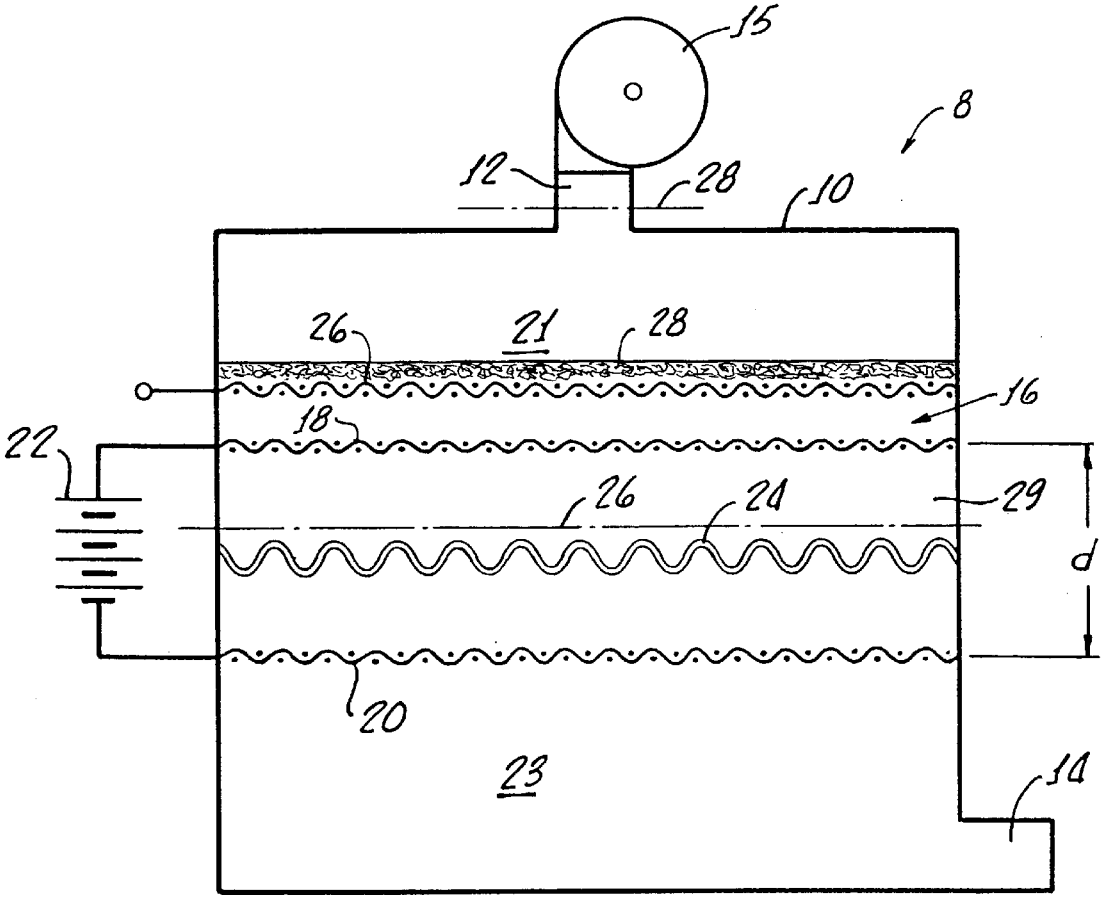
FIG. 1 is a schematic diagram of the present invention showing the principle of a third electrode along with an additional coarse, porous filter material adjacent to the third electrode.

Turning to FIG. 1, there is illustrated filter apparatus 8 constructed in accordance with the underlying principles of the invention. Reference to this principle may be found in U.S. Pat. No. 5,647,890 which is incorporated herewith by this specific reference thereto not only for a description of the induced electrode but for the inclusion of all supporting Figures and Examples therein.

Again with reference to FIG. 1, filter housing 10 has an inlet pipe 12 at its top and an outlet pipe 14 at its bottom. A gaseous fluid, such as air, contaminated with suspended particulate materials, e.g., dust or smoke, is conveyed through a flow path from inlet pipe 12 to outlet pipe 14 by appropriate impelling means schematically illustrated as a pump 15.

The housing 10 encloses a filter chamber 16 in which apertured electrodes 18, 20 are disposed, transversely to the axis of the chamber 16, between an intake plenum 21 and outlet plenum 23.

The electrodes 18, 20 may consist of a metallic mesh, a perforated metallic plate, carbonized layers of a filter material or any other suitable materials; in either event, the openings in the electrodes 18, 20 are large enough not to significantly affect the air flow through the chamber 16.

One of the electrodes may be used as a filter. In this instance, the filter would include a conductive filter material or a non-conductive material with conductive particles or strands interspersed therein. The electrodes 18, 20 are connected to a direct current voltage source 22. The polarity of the electrodes 18, 20 does not greatly affect the operation of the invention in most instances.

Disposed between the electrodes 18, 20 is a porous filter material 24 of a shape discussed in more detail hereinafter. The material 24 is preferably a non-hygroscopic material forming a mesh. The filter material 24 is preferably dielectric or partially conductive. Many filter materials may be used. Examples of suitable materials include paper, foam, glass fiber, synthetic fiber, cloth, natural fibers such as cotton, or materials with a natural electrostatic charge such as 3M's Filtrete® or Toray's Tori-Micron® (Japan). An example of a suitable conductive material is a metal-impregnated fiber sheet developed by Toray Co. Ltd. and marketed under the name "Soldion paper®" by Shiga Shokusan Inc. of Japan. However, the filter material may include any suitable coating which may enhance the capture and/or destruction of specific particulates, or airborne particles, for example, viruses, bacteria or pathogens, such coatings being well known in the art.

The average pore size of the filter may be about ten to fifty times the average diameter of the particles to be captured, but even particles as small as 1/500 average pore size can be captured to a significant degree if the flow velocity is slow enough. Depending upon the application, the material 24 may be as thick as 25 mm (in a uniform, varying density, or multilayered configuration) or as small as about 0.5 to 1 mm thick.

The ability to capture particles with much larger porosity, using induced churning motion by a non-ionizing electric field, enhances the holding capacity of the filter because particle capture occurs throughout the thickness of the material 24 and not just on the surface of the filter material. Stacked pleated filter materials—such as commonly used in HEPA, ULPA, and similar filters—are preferably used for simplicity in providing the area amplification needed for slowing the fluid flow rate per unit area as described below.

However, for optimum capture of the particles, it is preferable to use a layered arrangement of filter materials with varying porosity. Also, the polarity for most effective filtration is somewhat dependent upon the nature of the filtered particles, e.g., dielectric particles, such as dioctyl phthalate (upstream positive preferable) vs. partially conductive particles, such as cigarette smoke (downstream positive preferable). The electrodes 18, 20 may be coated with an insulating material to avoid shorting or extreme reduction of resistance between the electrodes 18, 20 by accumulation of particles in the filter material 24.

An air gap may be placed between the filter material 24 and the electrode 18 (positive electrical potential) or electrode 20 (ground). Such separation creates substantial economy in electric power consumption while the efficiency of the filter further increases. The overall electric power in question may not be considered large in normal usage; however, this consideration is very useful when electric power is very limited, such as in the case of portable, battery-operated product applications.

A third electrode 26 is utilized together with a second, preferably coarse, porous filter material 28 attached, or adjacent thereto. The third or induction electrode 26 produces a synergistic and substantial improvement in particle capturing efficiency described in greater detail in U.S. Patent No. 5,647,890, incorporated herein.

The third electrode 26 is not wired directly to any power supply nor the other two electrodes 18, 20 but has induced potential by its proximity to the nearest electrode 18 or 20.

The present invention provides a simple, highly efficient, energy-saving electrostatic particle filter, which operates at substantially lower voltages and negligible power consumption in comparison with conventional electrostatic precipitators and uses an interaction between natural Van der Waals forces and a nonionizing electrical field to create a churning motion of airborne particles, to increase the residence time of particles, and to increase the probability of trapping airborne particulates in the filter materials. This arrangement makes it possible to capture particles of widely varying sizes more efficiently with less chance of clogging and without the formation of ozone. This arrangement also allows the porosity of the filter material to be considerably larger than the size of the particulates to be captured without a reduction in effectiveness. This results in a much lower air pressure drop across the filter, energy saving in creating air flow, and low maintenance costs.

In addition, specific filter coatings, hereinabove noted, are used to their ultimate capacity in the present invention. While such coatings have been used heretofore in conventional filters, the only effective area of such coating is that side of the conventional filter facing oncoming air flow.

Because of the churning action of airborne particles caused by the structure of the present invention as illustrated in FIG. 1, the coating on all sides of the fibers which make up the filter 24 is available for capture of airborne particles. Hence, the present invention enhances the effectiveness of such coatings. Appreciation of this effect may be had from the following brief outline of the principles of the present invention.

Van der Waals forces are molecular electrostatic fields which are inherently associated with foreign particles suspended in fluid and gases, such as air. A common manifestation of these forces is the attraction of dust particles to plastic or other surfaces. Once the particles make contact with the surfaces, the Van der Waals force increases dramatically and makes the particles adhere to the surface.

The particles are not easily removable because the Van der Waals force is proportional to $1/a^6$, where "a" is the effective distance of the particles from the surface. Thus, this force provides a strong bond once contact is established. At any significant distance from the surface, the Van der Waals force is a very small force (defined by Van Nostrand's *Encyclopedia of Science* as interatomic or intermolecular forces of attraction), and does not come into play in conventional electrostatic precipitators which mostly rely on the direct attraction between charged particles and collecting surface with high potential by Coulomb's law $1/a^2$ and because the flow rate is too high to allow any significant particle capture by the Van der Waals force.

The filter of the present invention accomplishes its objectives by using a filter geometric configuration which slows the flow of the air or other gaseous fluid through the filter material to the point where the particles suspended in the fluid can be captured and held in the filter materials, essentially by the Van der Waals force. Furthermore, while the flow of the air through the filter material longitudinally of the air flow path is slowed by a specific geometry, the active, generally transverse motion of the particles between the electrodes substantially increases the chance that the particles will make contact with the filter materials.

Consequently, the filter material will capture a wide range of particles, starting with particles having a much smaller size than the filter pore size, and, of course, particles having a larger size, and this minimizes pressure drop, increases the dust-holding capacity, and minimizes clogging of the filter. By the same token, as the pore size is much larger than the particles, the thickness of the filter materials can be substantially increased in comparison to filter materials in conventional filters. The increased thickness of the filter materials thus further contributes to much more effective filtration. In the filter of the present invention, the electrostatic field is used only to enhance the action of the Van der Waals force and to impart to the particles the generally transverse motion which facilitates their capture.

Within limits, the operation of the filter of the present invention is dependent only upon the absolute voltage difference across the filter material 24, and influence of the voltage induced on the third electrode 26, not upon the volts/cm field strength of conventional electrostatic filters. Consequently, the thickness of the filter materials can be varied to accommodate different environments without changing the electrical components.

In accordance with another aspect of the invention, the action of the Van der Waals force with filter surfaces can be substantially enhanced by causing one of the electrodes 18, 20 to touch the filter materials and the other electrode 18, 20 to have an air gap between it and the filter material 24, or by interweaving or embedding conductive fibers in the filter material 24.

The filter material 24, can be conductive or imbedded with the conductive fibers. The embedded conductive fibers can consist of chopped microscopic substances (both isolated or non-isolated) which create a vast number of air gaps between the tips of conductive fibers that produce microscopic but strong electric fields in the air gaps and throughout the filter materials. However, although materials of this type are generally designed for applications involving the release of static electricity by internal arcing between the fibers of the materials. In any event, arcing should be prevented. This results in further enhancement of the particle attraction by the Van der Waals force, and therefore more efficient filtration.

Similarly, when the filter materials include or are treated or coated with an active substance, as hereinabove noted, such as, for example, activated charcoal, which chemically reacts with and absorbs the undesirable substance (e.g., odors, hazardous particles, poisonous gas, microorganisms) in air, the churning motion of particles created by the electrostatic field within the filter materials accelerates the chemical reaction and absorption and destruction of the undesirable substances (such as viruses, bacteria, etc.) in the filter materials. Similarly, the effectiveness of the activated charcoal for odor absorption is enhanced by the electric fields by the present invention.

In order for the filter of this invention to effectively utilize the Van der Waals force associated with the particles to be captured, the flow velocity of the gaseous fluid should be as low as one's design criteria allows, e.g. less than 0.1 m/sec.

The slow flow velocity of the particles in the direction of flow importantly causes the particles to remain in the filter material 24 long enough to be captured. The electrostatic field imparts a turbulent motion to the particles which greatly enhances the chances, during their passage through the filter material 24 of being captured by the Van der Waals force. For this reason, it is preferable for the filter material 24, in the inventive filter to be thick (e.g., 2–3 mm) in the direction of flow, contrary to conventional filters (thickness 0.5–1 mm) in which most of the particle capture occurs at the materials' upstream surface.

In accordance with the present invention the DC potential difference between the electrodes 18, 20 should be at least 3 kV but not more than 10 kV, and preferably in the range of 3–9 kV, with the optimum being about 7 kV. The induced electrical potential on electrode 202 is also in the range of 3–9 kV, preferably 6–9 kV. The precise voltage selection is dependent upon the particulate material of interest, the porosity of the filter, the type of filter material used, and the velocity of the air stream through the filter.

Above 10 kV, filtration continues to improve. However, improvement is due to a partially induced ionization of the particles, which begins to occur in localized areas at about 11 kV/cm electric field intensity, and above, and the demand of electric current increases quite rapidly.

The problem with this is that when the filter itself thus generates ionized particles, some of those particles are entrained by the air stream and attach themselves to walls and ducts downstream of the filter. In those positions, the particles become contaminants with an unpredictable timing of release into the air—an undesirable situation for a clean room atmosphere, for example. In summary, too high a voltage wastes energy and presents a danger of ozone production without significantly improving filter performance; too low a voltage degrades the performance of the filter.

The distance, d, between the electrodes 18, 20 and 26, can vary at any given voltage. As a practical matter, the distances are preferably kept in the range of about 13 mm for effective filtration. Too small a distance creates a danger of arcing; too great a distance degrades the performance of the filter. The voltage level affects the size of particles that can be captured, as well as the depth of their penetration into the filter material 24.

Figure 2:
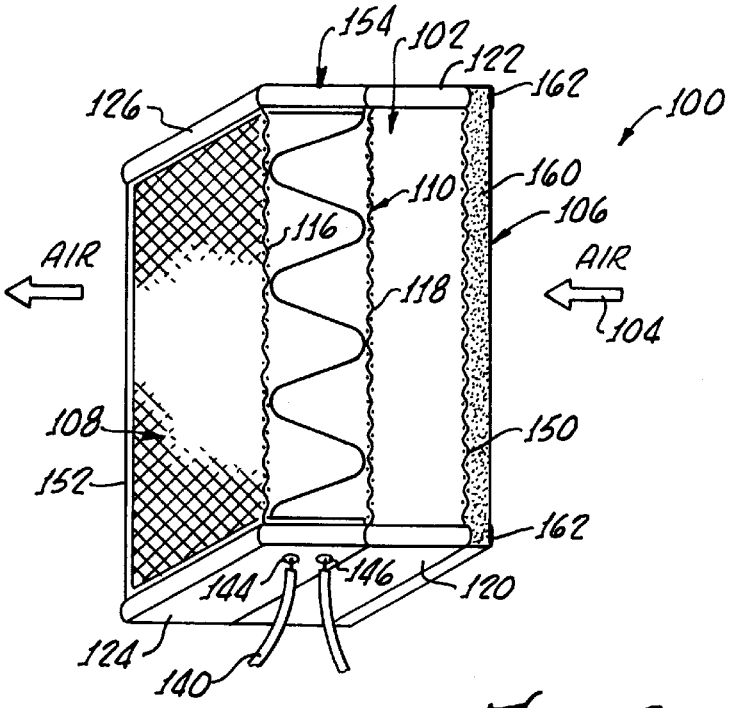
FIG. 2 is a perspective diagram of an alternative embodiment of the present invention.

Turning now to FIG. 2 there is shown filter apparatus 100 generally showing a filter chamber 102 which provides a means for defining an airflow path shown by the arrow 104 between inlet 106 and an outlet 108. A replaceable porous filter cartridge 110, see also FIG. 3, includes a pleated material 112 having a porous size substantially larger than the average size of the particles being trapped, as hereinbefore discussed.

As also hereinabove noted that the material 112 has a collection surface thereon substantially larger than a cross section of the flow path through the chamber 102 which is of course produced by the pleated nature of the material 112.

Figure 4:
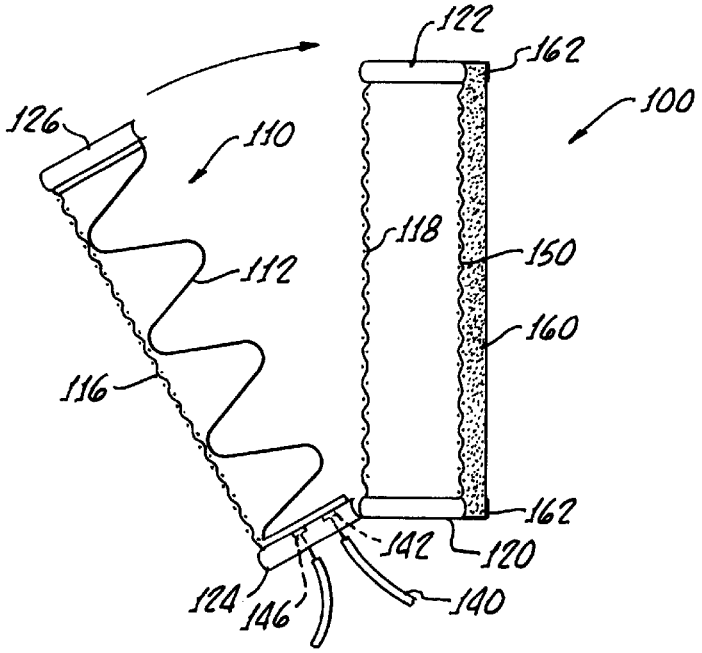
FIG. 4 is a drawing of the embodiment shown in FIG. 2 with sub-frames being shown separated to enable removal and replacement of the filter cartridge shown in FIG. 3.
Figure 3:
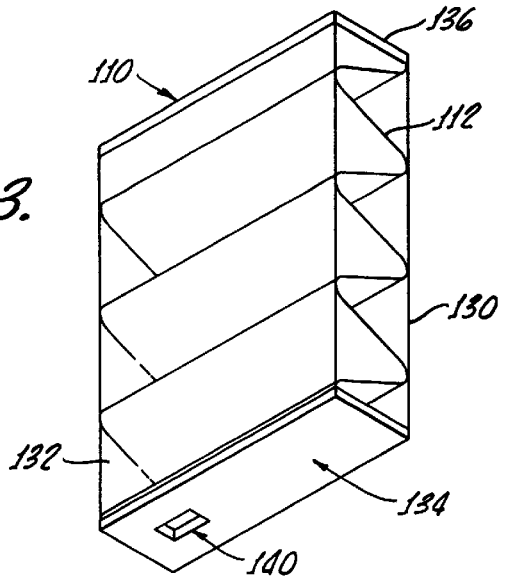
FIG. 3 is a perspective diagram of a filter cartridge in accordance with the present invention.

First and second electrodes 116, 118 are disposed with the filter material 112 therebetween as shown in FIG. 2. The first and second electrodes 116, 118 may be attached to end pieces 120, 122, 124, 126 respectively as shown in FIGS. 2 and 4, or alternatively as shown in FIG. 3, first and second electrodes 130, 132 may be attached to end pieces 134, 136 of the cartridge 110. In this embodiment, the filter cartridge 110 provides significant advantage since an electrical potential may be maintained across the first and second electrodes 130, 132 after removal from the apparatus 10 in order to prevent release of trapped particles and the removed filter cartridge 110 as hereinafter described in greater detail.

In that regard, means are provided by way of electrical connectors 140 which may be attached to a remote or portable potential source (not shown) for maintaining the electrical potential across the electrodes 130, 132. This connector in combination with contacts 144, 146 in the end plate 124, see FIG. 2, also provides a means for applying a selected DC voltage across the first and second electrodes during operation of the filter apparatus 100 and for also inducing voltage into a third, or induction, electrode 150.

The end plates 120, 122, 124, 126 and interconnecting risers 152 provide the frame means 154 for removeably supporting the filter cartridge 110 supporting the first, second and third electrodes 116, 118, 150 in order to electrify, by induction the third electrode 150 with the voltage in the third electrode 150 in order to electrify, by induction, the third electrode 150 with a voltage in the third electrode 150 in order to increase trapping of particle by the filter apparatus 100 as hereinabove discussed in detail in connection with embodiment 8 shown in FIG. 1.

As is most clearly shown in FIG. 4 end plates 120, 122, 124, 126 provide separable sub-frames of the framing means 154 which enable replacement of the filter cartridge 110 by separation of the sub-frames 120, 122, 124, 126. Sub-frames 120, 122, 124, 126 may be hindgeably coupled to one another or attached in any suitable manner enabling easy separation thereof. As hereinabove earlier discussed the filter material 112 may have variable porosity and additionally a second porous filter 160 may be provided and removeably disposed adjacent to the third electrode 150. Brackets 162 may be utilized for facilitating removal and replacement of the second porous filter 160.

As a result of the changeable cartridge 110, the use of a plurality of cartridges, similar in geometric configuration to the cartridge 110, provide filter assembly apparatus 100 capable of accommodating various situations in the marketplace for providing the most appropriate means of air purification.

For example, in the same filter assembly, different filter cartridges 110 can be utilized without the need to discard the essential assembly components such as, for example, the frame means 154. Thus, the embodiment 100 may be used alternatively for economically capturing submicron particulates, capturing and removing pathogens, or eliminating odors.

Only the filter cartridge 110 with a different filter medium 112 need be replaced. It should also be appreciated that other geometric configurations of the present invention should be considered to be within the scope of the present invention.

Figure 5:
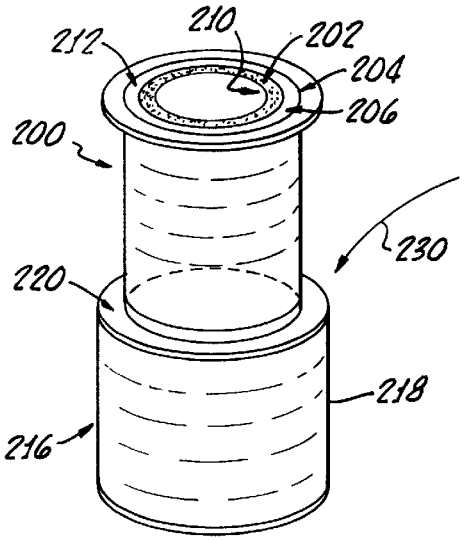
FIG. 5 is a perspective diagram of a cylindrical filter assembly in accordance with the present invention.
Figure 6:
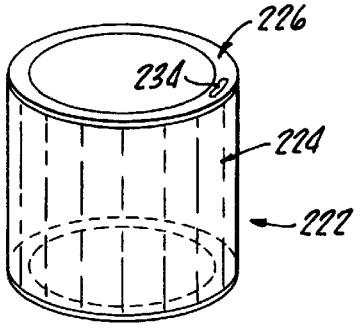
FIG. 6 is a diagram of a cylindrical cartridge embodiment of the present invention shown in FIG. 5.

As an example, turning to FIGS. 5 and 6 there is shown an electrode assembly 200 which includes a first, or inlet electrode 202 and a second, or mid electrode 204 with an air gap 206 therebetween. A replaceable third, or prefilter 210 is disposed in front of the inlet electrode 202 while a spacer 212 establishes the space 206 between the electrodes 202, 204. In this instance the inlet electrode 202 is induced with voltage during operation. A second part 216 of the embodiment 200 includes an outlet, or second electrode 218 which is spaced apart from the middle electrode 204 by a spacer 220.

As shown in FIG. 6 a cylindrically formed filter cartridge 222 consists of a pleated material 224 held by an end cap, or spacer, 226 which is inserted between the middle electrode 204 and the outlet electrode 218 as indicated by the arrow 230. Alternatively the middle electrode 204 and exit electrode 218 may be incorporated into the cartridge 222 shown in FIG. 6 and electrical contact 234 provided.

Figure 7:
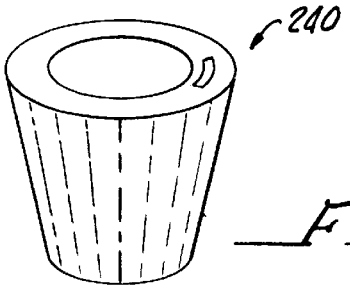
FIG. 7 shows a example of a truncated conical filter cartridge in accordance with the present invention.

FIG. 7 shows an alternative truncated conical cartridge 240, corresponding frame structure not being shown for clarity since the drawing is provided only for illustrating the various geometric configurations considered to be within the scope of the present invention.

Although there has been hereinabove described a filter for particulate materials in gaseous fluids in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. Filter apparatus for trapping particles suspended in a gaseous fluid stream, said filter apparatus comprising:

filter chamber means for defining an air flow path between an inlet and an outlet;

a replaceable porous filter cartridge positioned in said flow path, said porous filter cartridge comprising a filter material having a pore size substantially larger than the average diameter of the particles to be trapped, said material having a collection surface thereon substantially larger than a cross-section of the flow path;

first and second electrodes disposed with the filter material therebetween and having means defining openings therein for enabling air flow therethrough;

means for applying a selected DC voltage across the first and second electrodes;

a third electrode having means defining openings therein for enabling air flow therethrough; and means for removably supporting the filter cartridge and supporting said first, second and third electrodes in order to electrify, by induction, the third electrode with a voltage in said third electrode in order to increase trapping of the particles by the filter apparatus.

2. The filter apparatus according to claim 1 wherein said frame means comprises separable subframe means for enabling replacement of the filter cartridge by separation of the subframe means.

3. The filter apparatus according to claim 2 wherein at least one of the first and second electrodes is disposed in the filter cartridge.

4. The filter apparatus according to claim 2 wherein the first and second electrodes are disposed in the filter cartridge.

5. The filter apparatus according to claim 4 wherein the means for applying a selected DC voltage comprises electrical contact means, disposed on the filter cartridge, for enabling maintenance of elective potential across the first and second electrodes when the filter cartridge is removed from said frame means in order to prevent release of trapped particles in the filter cartridge material.

6. The filter apparatus according to claim 1 wherein the filter cartridge material has varying porosity with an increasing pore size along the air flow path.

7. The filter apparatus according to claim 1 further comprising a second porous filter removably disposed adjacent to the third electrode.

8. Filter apparatus for trapping particles suspended in a gaseous fluid stream, said filter apparatus comprising:

filter chamber means for defining an air flow path between an inlet and an outlet;

a plurality of porous filter cartridges positioned in said flow path, each porous filter cartridge comprising a different filter material having a pore size substantially larger than the average diameter of the particles to be trapped, each filter material having a collection surface thereon substantially larger than a cross-section of the flow path;

first and second electrodes disposed with one of the porous filter cartridges therebetween and having means defining openings therein for enabling air flow therethrough;

means for applying a selected DC voltage across the first and second electrodes;

a third electrode having means defining openings therein for enabling air flow therethrough; and frame means for removably supporting one of the filter cartridges and supporting said first, second, and third electrodes in order to electrify, by induction, the third electrode with a voltage in said third electrode in order to increase trapping of the particles by the filter apparatus.

9. The filter apparatus according to claim 8 wherein said frame means comprises separable sub-frame means for enabling replacement of the filter cartridges by separation of the sub-frame means.

10. The filter apparatus according to claim 9 wherein at least one of the first and second electrodes is disposed in each of the filter cartridges.

11. The filter apparatus according to claim 9 wherein the first and second electrodes are disposed in each of the filter cartridge.

12. The filter apparatus according to claim 11 wherein the means for applying a selected DC voltage comprises electrical contact means, disposed on each of the filter cartridges for enabling maintenance of elective potential across the first and second electrodes when one of the filter cartridges is removed from said frame means in order to prevent release of trapped particles in the removed filter cartridge.

13. The filter apparatus according to claim 8 wherein each of the filter cartridge materials has varying porosity with an increasing pore size along the air flow path.

14. The filter apparatus according to claim 8 further comprising a second porous filter removably disposed adjacent to the third electrode.

15. Filter apparatus for trapping particles suspended in a gaseous fluid stream, said filter apparatus comprising:

a porous filter;

first and second electrodes disposed with the porous filter therebetween and having means defining openings therein for enabling air flow therethrough;

means for applying a selected DC voltage across the first and second electrodes;

a third electrode having means defining openings therein for enabling air flow therethrough; and means for positioning and supporting said third electrode proximate said first and second electrodes in order to electrify, by induction, the third electrode with a voltage in said third electrode and increase trapping of the particles by the filter apparatus.

16. In filter apparatus for trapping particles suspended in a gaseous fluid stream, said filter apparatus comprising a porous filter cartridge including:

a porous filter; impelling means for causing a gaseous fluid stream and particles suspended therein to flow through said porous filter; first and second electrodes disposed with the filter material therebetween and having means defining openings therein for enabling air flow therethrough; means for applying a selected DC voltage across the first and second electrodes; and a third electrode having means defining openings therein for enabling air flow therethrough;

the improvement comprising frame means for positioning and supporting said first, second and third electrodes in order to electrify, by induction, the third electrode with a voltage in said third electrode in order to increase trapping of the particles by the filter apparatus, said frame means including separable sub-frame means for supporting said porous filter and enabling replacement thereof by separation of the sub-frame means.

17. The filter apparatus improvement according to claim 16 wherein at least one of the first and second electrodes is disposed in the filter.

18. The filter apparatus improvement according to claim 16 wherein the first and second electrodes are disposed in the filter.

19. The filter apparatus improvement according to claim 18 wherein the means for applying a selected DC voltage comprises electrical contact means, disposed on the filter for enabling maintenance of elective potential across the first and second electrodes when the filter is removed from said frame means in order to prevent release of trapped particles in the filter.

20. The filter apparatus improvement according to claim 16 further comprises a second porous filter removably disposed adjacent to the third electrode.

21. A filter cartridge for filter apparatus, the filter apparatus having filter chamber means for defining an air flow path between in inlet and an outlet; impelling means for causing said gaseous fluid stream and particles suspended therein to flow along said flow path and through said porous filter; an induction electrode having means defining openings therein for enabling air flow therethrough; and means for removably supporting the filter cartridge; said filter cartridge comprising:

a porous filter;

first and second electrodes disposed with the porous filter therebetween and having means defining openings therein for enabling air flow therethrough;

means for applying a selected DC voltage across the first and second electrodes; and means for enabling positioning and supporting said first and second electrodes proximate said induction electrode in order to electrify, by induction, the induction electrode with a voltage in said induction electrode in order to increase trapping of the particles by the filter cartridge.

22. The filter cartridge according to claim 21 wherein the means for applying a selected DC voltage comprises electrical contact means, disposed on the filter cartridge, for enabling maintenance of electrical potential across the first and second electrodes when the filter cartridge is separated from said filter apparatus in order to prevent release of trapped particles in the porous filter.

23. The filter apparatus according to claim 22 wherein the porous filter has varying porosity with an increasing pore size along the air flow path.

* * * * *

UNITED STATES PATENT AND TRADEMARK OFFICE

CERTIFICATE OF CORRECTION

PATENT NO. : 5,855,653

DATED : January 5, 1999

INVENTOR(S) : Yujiro Yamamoto

It is certified that error appears in the above-identified patent and that said Letters Patent are hereby corrected as shown below:

| Column | Line | Correction |
|---|---|---|
| 1 | 11 | Replace "disposed" with "disposable" |
| 1 | 61 | Replace "particular" wth "particulates" |
| 6 | 39 | Replace ". In" with ", in" |
| 7 | 46 | After "noted" delete "that" |
| 8 | 36 | Replace "particulates" with "particles" |
| 10 | 20 | Replace "cartridge" with cartridges" |

Signed and Sealed this

Eighth Day of May, 2001

*Attest:*

Nicholas P. Godici

NICHOLAS P. GODICI

*Attesting Officer*

*Acting Director of the United States Patent and Trademark Office*